United States Patent [19]

Moore

[11] Patent Number: 4,911,611

[45] Date of Patent: Mar. 27, 1990

[54] COLLAPSIBLE FAN

[76] Inventor: Daryl Moore, 2525 NW. 32nd St., Oklahoma City, Okla. 73112

[21] Appl. No.: 385,352

[22] Filed: Jul. 27, 1989

[51] Int. Cl.[4] ..... A45D 27/00

[52] U.S. Cl. ..... 416/72; 416/70 A; 416/73

[58] Field of Search ..... 416/70 A, 73, 142, 69, 416/70 R

[56] References Cited

U.S. PATENT DOCUMENTS

| | | | |
|---|---|---|---|
| D. 294,652 | 3/1988 | Chang | D2/253 |
| 541,392 | 6/1895 | Scheuer | 416/73 |
| 543,252 | 7/1895 | Jones | 416/70 A |
| 555,339 | 2/1896 | Rubin | 416/73 |
| 835,433 | 11/1906 | Hulsizer | 416/73 |
| 1,630,397 | 5/1927 | Marui | 416/73 |
| 2,392,671 | 1/1946 | Husted | 416/5 |
| 2,581,643 | 1/1952 | Francis | 416/73 |
| 4,386,126 | 5/1983 | Turner | 416/70 A X |

FOREIGN PATENT DOCUMENTS

| | | | |
|---|---|---|---|
| 204624 | 1/1902 | Fed. Rep. of Germany | 416/72 |
| 1306746 | 9/1962 | France | 416/73 |
| 287661 | 8/1931 | Italy | 416/70 A |

*Primary Examiner*—Everette A. Powell, Jr.

[57] ABSTRACT

A collapsible fan is disclosed which can be easily stored, include logos and messages, and unfolds into a fan that is about six times its folded size. The fan includes a spring-type frame foldable into itself and unfoldable to its original shape, and a membrane connected across the spring frame. A carrying case has an opening in one portion for receiving the collapsed spring frame and membrane.

4 Claims, 1 Drawing Sheet

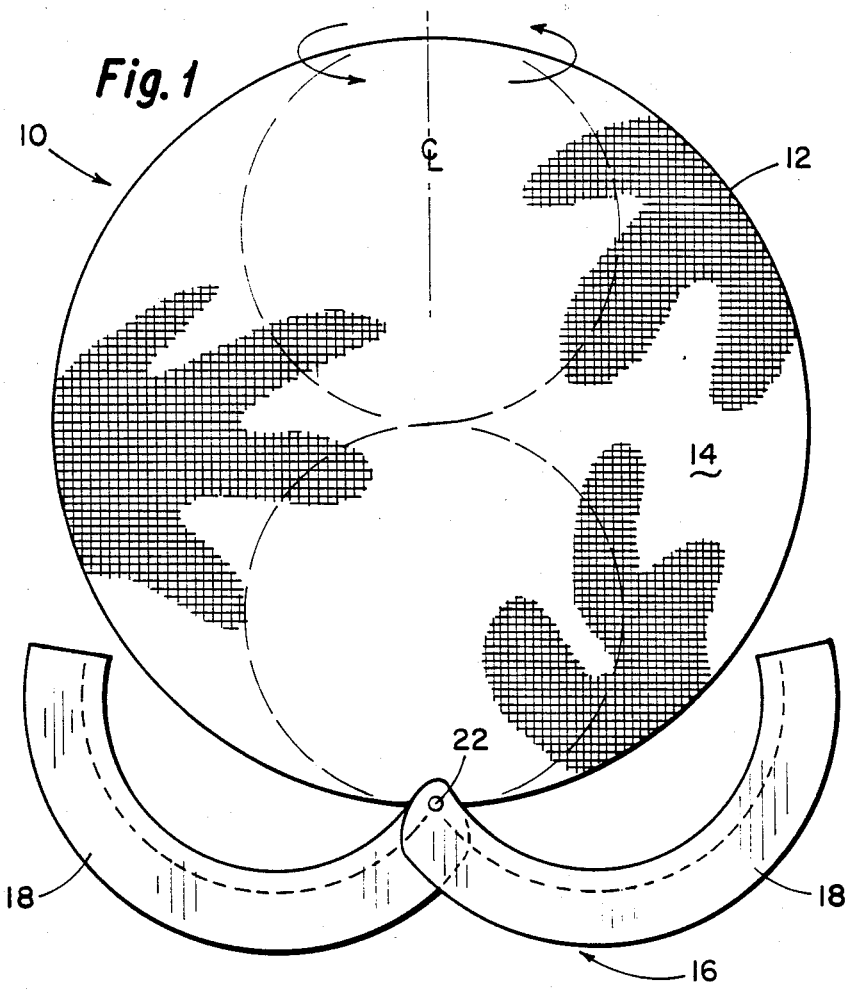
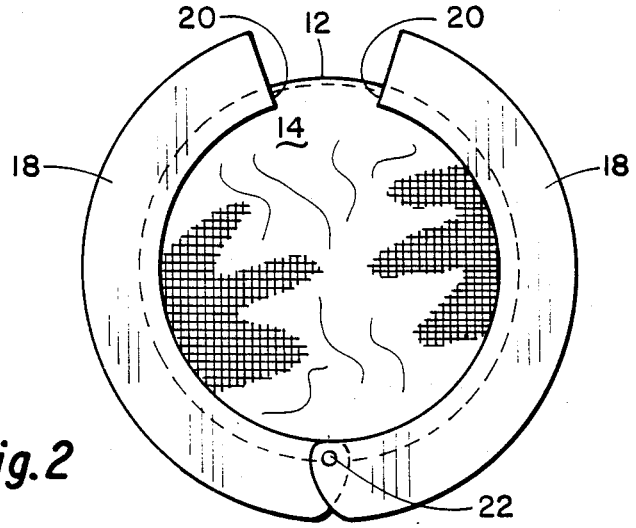
Fig. 2

COLLAPSIBLE FAN

BACKGROUND OF THE INVENTION

1. Field of the Invention

The present invention relates to hand-held fans and, more particulary, to a collapsible fan that collapses into itself to greatly reduce its size.

2. Setting of the Invention

Hand-held fans have been used for centuries for artistic purposes, such as in plays, and more commonly for cooling one or more persons. The most common type of hand held fans are generally referred to as Chinese fans, which have either a plurality of blades commonly pivotally connected and which extend radially or which have a single piece of paper which is folded to have a plurality of pleats. An example of such a fan is disclosed in U.S. Pat. No. D. 294,652. Another type of hand held fan is generally a stiff piece of paper stock glued or stapled to a wooden handle, Examples of this type of fan are disclosed in U.S. Pat. No. 4,386,126 and Italian Pat. No. 287,661.

While these types of fans are useful there is a need for a fan that collapses into itself more fully, i.e., a fan that greatly reduces its size so to be more easily carried, and includes an integral carrying case.

SUMMARY OF THE INVENTION

The present invention has been contemplated to overcome the foregoing deficiencies and meet the above described needs. Specifically, the present invention is a hand held fan that folds or collapses into itself in a unique manner to reduce its size (in area) by about a factor of six times. The collapsible fan includes a collapsible spring-type frame foldable into itself and unfoldable to its original shape. A membrane is connected across the spring frame with the spring frame and membrane stored within a case which is connected integrally thereto.

BRIEF DESCRIPTION OF THE DRAWINGS

FIG. 1 is a front elevational view of a fan, embodying the present invention, in an unfolded condition.

FIG. 2 is a front elevational view of the fan of FIG. 1 in a folded condition.

DETAILED DESCRIPTION OF THE PREFERRED EMBODIMENTS

As shown in FIG. 1, a collapsible fan 10 includes a spring-type frame 12, a membrane 14 connected thereacross, and a case 16. The frame 12 is designed to be foldable into itself and be unfoldable to its original, natural shape. The frame 12 can be formed from spring tempered, high-yield stainless steel wire, such as 0.125" O.D. The unique folding operation of this frame 12 will be described below. The membrane 14 provides the air-moving surface and as such should be substantially free of holes. Because the membrane 14 must be collapsed and unfolded a number of times, a high-yield material should be used, such as cloth material. Paper or sheet plastic may be used but may not be capable of repeated foldings without tearing. The membrane 14 can be glued or stitched to the frame 12 as is desired.

The case 16 provides a place for the folded fan to be stored within and also, in the unfolded position, acts as a handle. The case 16 can include at least one housing 18 having a generally rectangular cross-section and having an opening 20 at least partially therewithin to encompass at least part of the folded frame 12 and membrane 14. At a pivot connection 22, such as a laterally extending pin or rod, the frame 12 is pivotally connected to a lateral end thereof. The case 16, shown in FIGS. 1 and 2, is formed from two "C"-shaped housings which act as "clam-shell" protectors of the collapsed frame 12 and membrane 14. The housings 18 also act as a convenient set of handles easily grasped by either hand. Further, the housings 18 can be formed into any desired shape, such as circles, triangles, logos and animals. In one embodiment of the present invention, the frame 12 is of generally circular shape and formed from 0.018×0.125 spring tempered, stainless steel wire. The membrane 14 is 10 mil. polyester fabric cloth stitched around the frame 12 is a taught manner. The case 16 is an injection molded "ABS" plastic dual handle (as shown in FIG. 1) pivotally connected together by a plastic, pressure fitted split pin rivet.

The unique folding procedure for the frame 12 will now be described. With the frame 12 in an unfolded condition, one hand grasps the case 16 adjacent the pivot 22, while a second hand grasps the top of the frame 12 adjacent the 12-O'clock positon. The hands are rotated 180° in opposite directions until the frame 12 has been twisted into a FIG. 8 (as shown by dotted lines in FIG. 1). Then, the hands are further rotated another 180° as before which causes the top loop of the FIG. 8 to fold downwardly into itself so that a concentric ring of loops (of the frame 12) is formed, as shown in FIG. 2. Thereafter, the housings can be pivotally moved from an open position to a closed position to at least, partially encompass and protect the frame 12 and membrane 14.

To unfold the fan, the housings/handles 18 are pivotted away from the frame 12. The fan is given a quick snap by wrist movement and the frame 12 will spring open. Or, one hand can grasp the frame 12 and rotate the frame 12 in a motion to unloop the coils and the frame 12 will naturally, and quite quickly, spring open to its full, natural and functional position.

The benefits of this type of fan are many; primarily, the fan's size can be far smaller (by a factor of about 6, in area) than its open size, thus allowing more air movement for less pocket or hand bag space. While the frame 12 has been described herein as being generally circular in shape, any shape can be used as long as it will fold into itself, as described above. The housings/handles 18 can be formed from any desired material, even wood, and can be imprinted with logos or messages. Further, the membrane 14 can be imprinted with one or more logos and/or messages, including sport teams names and colors.

wherein the present invention has been described in particular detail with respect to the drawings attached hereto, it should be understood that other and further modifications, apart from those shown or suggested herein, may be made within the scope and spirit of the present invention.

What is claimed is:

1. A collapsible fan, comprising:

a spring-type frame adapted to have a first portion twisted with respect to a second portion to cause the frame to be collapsed to substantially reduce its overall size a membrane connected across the frame; and a case having an opening in one portion thereof for receiving the frame and membrane in a collapsed condition, the frame being pivotally connected to the case.

2. The collapsible fan of claim 1 wherein the frame is generally circular.

3. The collapsible fan of claim 1 wherein the case comprises at least one housing having a rectangular cross-section with the frame being pivotally connected to a lateral end thereof.

4. The collapsible fan of claim 3 wherein the case comprises two opposed "C"-shaped housings pivotally connected at opposed lateral ends thereof with the frame being connected adjacent said connection.

* * * * *